US010629390B2

(12) United States Patent
Kuhn

(10) Patent No.: US 10,629,390 B2
(45) Date of Patent: Apr. 21, 2020

(54) CONTROL MODULE FOR ELECTRICAL SWITCHING DEVICES

(71) Applicant: SOCOMEC, Benfeld (FR)

(72) Inventor: Denis Kuhn, Obernai (FR)

(73) Assignee: SOCOMEC, Benefeld (FR)

( * ) Notice: Subject to any disclaimer, the term of this patent is extended or adjusted under 35 U.S.C. 154(b) by 0 days.

(21) Appl. No.: 16/309,477

(22) PCT Filed: Jul. 24, 2017

(86) PCT No.: PCT/EP2017/068644
§ 371 (c)(1),
(2) Date: Dec. 13, 2018

(87) PCT Pub. No.: WO2018/024531
PCT Pub. Date: Feb. 8, 2018

(65) Prior Publication Data

US 2019/0206636 A1 Jul. 4, 2019

(30) Foreign Application Priority Data

Aug. 2, 2016 (FR) ..... 16 57510

(51) Int. Cl.
*H01H 9/26* (2006.01)
*H01H 19/64* (2006.01)
(Continued)

(52) U.S. Cl.
CPC ..... *H01H 9/26* (2013.01); *H01H 3/40* (2013.01); *H01H 19/24* (2013.01); *H01H 19/64* (2013.01); *H01H 2011/0025* (2013.01)

(58) Field of Classification Search
CPC .. H01H 9/24; H01H 9/26; H01H 9/28; H01H 13/568; H01H 19/65; H01H 2011/0025; H01H 71/10
See application file for complete search history.

(56) References Cited

U.S. PATENT DOCUMENTS 7,223,929 B2 5/2007 Dumont
7,679,018 B2 * 3/2010 Kolmonen ..... H01H 3/42 200/500
(Continued)

FOREIGN PATENT DOCUMENTS

CN 105 336 519 A 2/2016
EP 0 823 720 A1 2/1998
(Continued)

OTHER PUBLICATIONS

International Search Report Corresponding to PCT/EP2017/068644 dated Dec. 5, 2017.
(Continued)

*Primary Examiner* — Vanessa Girardi
(74) *Attorney, Agent, or Firm* — Davis & Bujold, P.L.L.C.; Michael J. Bujold

(57) ABSTRACT

A modular electrical switching device (1A) obtained by juxtaposing a control module (10) and a switching module (20), each comprising a mechanism that rotates about a rotation axis (A), coupled together by complementary coupling end pieces (11, 12; 21, 22). The control module (10) is designed to be controlled by a control rod (3) as well by a front control through a front entry opening (30) provided on the front side of the control module (10) as by left or right side control through two side entry openings (34, 35) provided on the sides of the control module (10), respecting a same direction of operation. The coupling end pieces (11, 12) of the control module (10) are provided on separated male (110) and female (120) coupling parts inserted between the modules (10, 20), when they are juxtaposed to form the switching device (1A).

21 Claims, 7 Drawing Sheets

(51) Int. Cl.

| | |
|---|---|
| ***H01H 3/40*** | (2006.01) |
| ***H01H 19/24*** | (2006.01) |
| *H01H 11/00* | (2006.01) |

(56) References Cited

U.S. PATENT DOCUMENTS

| | | | | |
|---|---|---|---|---|
| 7,863,530 | B2 * | 1/2011 | Mattlar ..... | H01H 19/64<br>200/50.32 |
| 2010/0326810 | A1 | 12/2010 | Song | |

FOREIGN PATENT DOCUMENTS

| | | | |
|---|---|---|---|
| EP | 1 648 008 | A1 | 4/2006 |
| EP | 1 709 652 | B1 | 8/2012 |
| GB | 2 384 626 | B | 3/2004 |
| WO | 02/49053 | A1 | 6/2002 |
| WO | 2005/069323 | A1 | 7/2005 |

OTHER PUBLICATIONS

Written Opinion Corresponding to PCT/EP2017/068644 dated Dec. 5, 2017.

* cited by examiner

CONTROL MODULE FOR ELECTRICAL SWITCHING DEVICES

TECHNICAL SCOPE

The present invention relates to a control module for a modular electrical switching device obtained by juxtaposing said control module and at least one switching module, said switching module comprising a switching casing containing at least one fixed contact and one moving contact coupled to a transmission mechanism that rotates about a rotation axis and is provided with two coupling end pieces accessible on the sides of the switching casing, said control module comprising a control casing containing an actuating mechanism that rotates about a rotation axis arranged to coincide with the rotation axis of said transmission mechanism when said control module and said at least one switching module are juxtaposed, said actuating mechanism being also provided with two coupling end pieces accessible on the sides of the control casing, arranged to be complementary to said coupling end pieces of said at least one switching module and aligned with them on the same rotation axis to allow their axial fitting when said control module and said at least one switching module are juxtaposed, said control module moreover comprising a control rod coupled on the one hand to said actuating mechanism through a front side of the control casing and on the other hand to an operating element located outside of said control casing, said actuating mechanism being provided with a front entry opening accessible through the front side of said control casing to receive an end of said control rod and realize a front control of said control module.

The present invention also relates to a modular electrical switching device obtained by juxtaposing said control module and at least one switching module.

PRIOR ART

The electrical switching devices are commonly called switches, fuse switches, changeover switches, inverter switches, etc., and they allow opening and closing electrical circuits in electrical installations to control industrial equipment, machine tools, etc. The modular switching devices include at the minimum a switching module that corresponds to a pole or a phase of the electrical network and a control module that allows opening or closing said switching module. The modularity of the switching devices is very appreciated, as it allows mixing various switching module variants and various control module variants according to the required functionalities.

The switching devices can be controlled manually by means of an operating element, which can be a rotating handle located on the front and called "front handle", or on the side and called "side handle", or of a swivel lever generally located on the front. These switching devices can also be, as the case may be, controlled automatically by a motorization coupled to the control rod either on the front or on the side. The choice of a front control or of a right or left side control depends on the configuration of the electrical cabinets and of the assembly options of the switching devices. Consequently, the actuating mechanism of the control module differs according to the front or side control mode. In a general way, for a front control, this actuating mechanism comprises an angle transmission that transforms the rotary movement of the handle transmitted to the control rod about a first rotation axis into a rotary movement of the actuating mechanism about a second rotation axis perpendicular to the first. An example of a control module with front control is described in publication EP 1 709 652 B1. In the case of a side control, this actuating mechanism is coupled directly to the handle through the control rod.

Moreover, it is known to couple the actuating mechanism to springs to create an abrupt actuation device which, independently of the rotation speed of the handle or of the swiveling speed of the lever, allows accelerating the switch-on and/or switch-off speed of the switching module. This abrupt actuation device makes the control module more complex to make it versatile, i.e. to allow actuating it by front control as well as by right or left side control.

Consequently, the manufacturers are obliged to offer different control module models according to the front or side control mode, which significantly multiplies the number of references of the products to manage, both on industrial and on commercial level. So, in a same current range, a switching device model, or the corresponding model of its control and switching modules, is produced in several versions, depending on whether it features front or side control. In addition, the choice of the model or version must generally be made when placing the order, which obliges the end customer to define accurately his specifications for the layout of his switching devices.

Some manufacturers offer so-called versatile switching devices, which are arranged to comply with both frontal and side control modes, as those described in publications CN 105 336 519 A, US 2010/0326810 A1, WO 02/49053 A1, EP 0 823 720 A1 and EP 1 648 008 BR. However, these versatile switching devices are not designed in a modular way and comprise complex and expensive actuating and transmission mechanisms with a high number of parts, whose mechanical reliability is not optimal, in particular in terms of service life, and whose dimensions are penalizing.

DESCRIPTION OF THE INVENTION

The present invention aims to overcome these disadvantages by offering a so-called versatile, universal or standard control module that can comply with all control modes: front, right side, left side, that is designed with a minimum of parts so as to be simple, cost-effective, mechanically reliable, of reduced size, this control module being designed to allow the manufacture of modular switching devices that can meet a wide range of assembly configurations, whatever the number of switching modules.

To this purpose, the invention relates to a control module of the kind described in the preamble, characterized in that the actuating mechanism comprises two side entry openings accessible on the sides of said control casing, aligned on the rotation axis of said actuating mechanism, and arranged to receive an end of said control rod and realize a right side control or a left side control of said control module, respecting a same direction of operation on the right and on the left of said control module.

The specific arrangement of the control module according to the invention, which comprises as standard three entry openings, of which one front entry opening and two side entry openings, allows leaving the choice of the configuration of the switching device and of its control mode to the end customer, without having to state the selected control mode when he places his order, which significantly simplifies the management of the production, of the stock and of the orders.

The coupling end pieces can be integrated in the actuating mechanism or formed on distinct coupling parts, separated from the actuating mechanism, arranged to be inserted between the actuating mechanism of the control module and the transmission mechanism of said at least one switching module when said modules are juxtaposed.

In a preferred embodiment, the coupling parts form a male coupling part and a female coupling part, one of the coupling parts comprising a male coupling end piece and the other coupling part comprising a female coupling end piece, said male and female coupling end pieces being arranged to be complementary respectively to the female and male coupling end pieces of said at least one switching module when said modules are juxtaposed.

The actuating mechanism and the coupling parts advantageously comprise complementary driving means that allow coupling them in rotation about the rotation axis.

The complementary driving means are preferably arranged to leave an angular play between the control rod and the actuating mechanism, and comprise at least one driving tooth provided on the coupling part or at the corresponding end of the actuating mechanism, and at least one receiving slot provided at the corresponding end of the actuating mechanism or on the coupling part, the receiving slot extending over an angular sector that is larger than that of the driving tooth to leave said angular play.

The coupling parts and said control casing can moreover comprise coded means making sure that every coupling part corresponds to one of the sides of said control casing.

The control module advantageously comprises at least one spring coupled to the control casing and to the actuating mechanism, arranged to form an abrupt actuation device for the moving contacts of said at least one switching module when said modules are juxtaposed.

In the preferred embodiment, the actuating mechanism comprises an angle transmission made of at least one input gear and one output gear integral with said actuating mechanism, and an additional entry part comprising said front entry opening, housed in the input gear by complementary driving means that allow their rotational coupling about an axis perpendicular to the rotation axis of the actuating mechanism and arranged to leave an angular play between the control rod and the front control actuating mechanism.

These complementary driving means can comprise at least one driving tooth provided on the additional entry part or on the input pinion, and at least one receiving notch provided on the input pinion or on the additional entry part, said receiving notch extending over an angular sector that is larger than that of the driving tooth to leave said angular play.

In the preferred embodiment of the invention, the actuating mechanism comprises a hollow shaft made of two coaxial shaft parts assembled axially together by connecting arms to provide a central recess wherein said angle transmission is housed at least partly. The connecting arms advantageously form end positions with fixed parts of said control module to delimit the extreme angular positions that the actuating mechanism can reach and which correspond to the switched-on and switched-off positions of said at least one switching module when said modules are juxtaposed.

Also to this purpose, the invention relates to a switching device of the kind described in the preamble, characterized in that the actuating mechanism of the control module comprises two side entry openings accessible on the sides of said control casing, aligned on the rotation axis of the actuating mechanism, and arranged to receive an end of the control rod and realize a right side control or a left side control of said control module, respecting a same direction of operation on the right and on the left of said control module.

According to the embodiment variants, the coupling end pieces of the actuating mechanism of said control module can be integrated in said actuating mechanism or formed on distinct coupling parts, separated from said actuating mechanism and arranged to be inserted between the actuating mechanism of said control module and the transmission mechanism of said at least one switching module.

Said coupling parts advantageously form a male coupling part and a female coupling part, the male coupling part comprising a male coupling end piece and the female coupling part comprising a female coupling end piece, said male and female coupling end pieces being complementary respectively to the female and male coupling end pieces of said at least one switching module.

In a first embodiment, the switching device comprises at least one switching module juxtaposed to one of the sides of said control module. In this case, the control rod can be coupled to the front entry opening of the control module to realize a front control of said switching device, or to the side entry opening of the free side of the control module to realize a side control of said switching device.

In a second embodiment, the switching device comprises at least one switching module juxtaposed to each side of said control module. In this case, the control rod is coupled to the front entry opening of the control module to realize a front control of said switching device.

As a variant, the switching device can comprise a side control accessory with an accessory casing provided with an additional coupling part comprising at one of its ends an additional side entry opening to receive the end of a control rod and at the other end fitting means complementary to those of the actuating mechanism of said control module.

BRIEF DESCRIPTION OF THE DRAWINGS

The present invention and its advantages will be better revealed in the following description of an embodiment given as a non limiting example, in reference to the drawings in appendix, in which.

ILLUSTRATIONS OF THE INVENTION AND BEST WAY OF REALIZING IT

Figure 1:
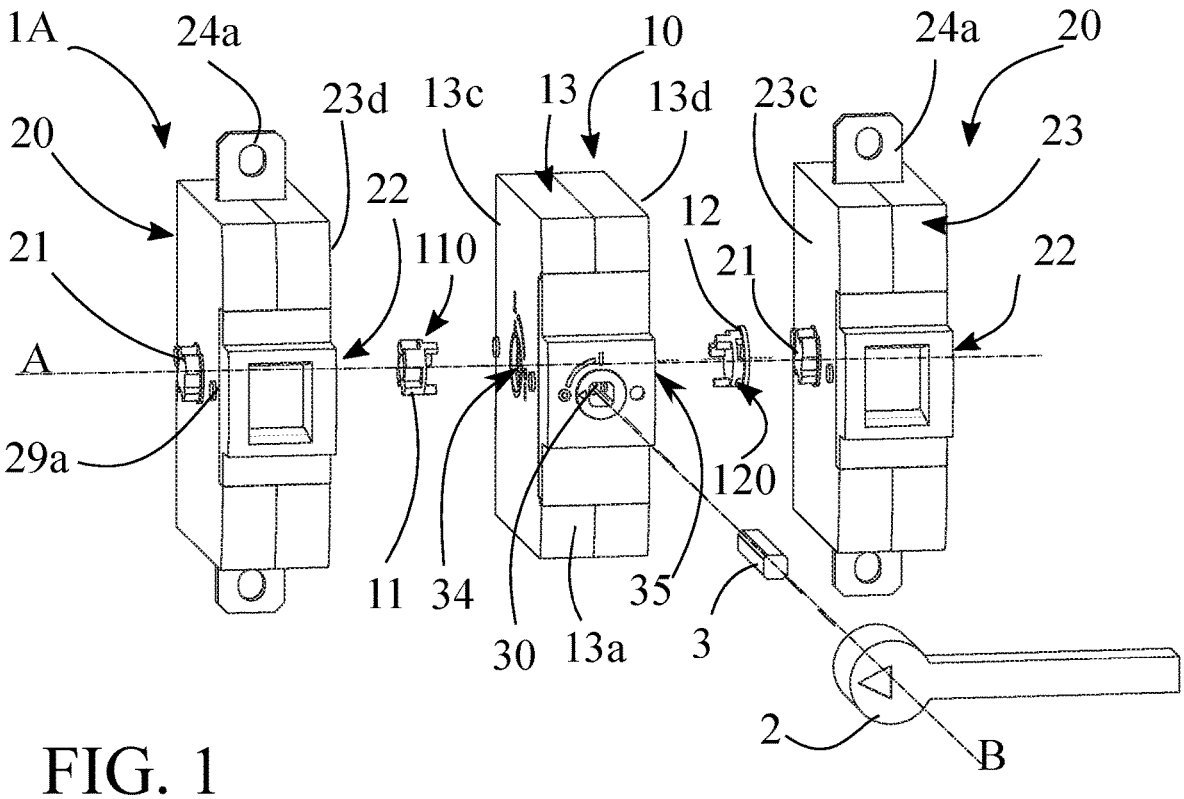
FIG. 1 is an exploded perspective view of a modular switching device according to the invention obtained by juxtaposing two switching modules on either side of a central control module by means of two left and right coupling parts.

In the illustrated embodiment examples, the identical elements or parts have the same numerical references.

Referring to the figures, control module 10 according to the invention is intended to equip a modular electrical switching device 1A, 1B, 1C, 1D, 1E, which is obtained by juxtaposing a control module 10 and at least one switching module 20, according to the number of phases of the electrical installation to be switched off and to the functionality of switching device 1A, 1B, 1C, 1D, 1E: switches, fuse switches, changeover switches, inverter switches, etc. Switching modules 20 are generally identical individual modules for every phase, i.e. they are arranged to switch one single phase of the installation. Of course, the invention is not limited to this case and can be considered for switching modules arranged to switch more than one phase. They are commonly called breaking poles and they can be juxtaposed side by side and coupled with each other by means of coupling end pieces 21, 22 described below. Control module 10 is generally a module common to several switching modules 20, which can be juxtaposed to one or two switching modules 20 and coupled with one and/or the other by means of coupling end pieces 11, 12 complementary to coupling end pieces 21, 22 of switching modules 20. The assembly of modules 10, 20 with each other is an axial fitting assembly of said coupling end pieces 11, 12; 21, 22, held by fastening elements such as tie rods passing all through modules 10, 20 in through openings provided to this purpose and not represented in the figures. Switching device 1A, 1B, 1C, 1D, 1E obtained is then intended for being mounted on rails or the like in an electrical cabinet or in any other electrical box. Modules 10, 20 moreover comprise centering pins 29 provided on the sides of modules 10, 20 and facilitating the alignment of modules 10, 20 between them.

Figure 3B:
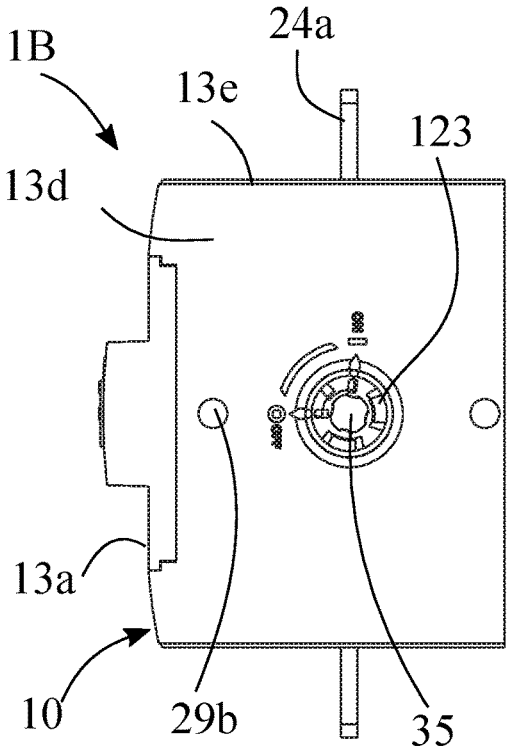
Figure 3A:
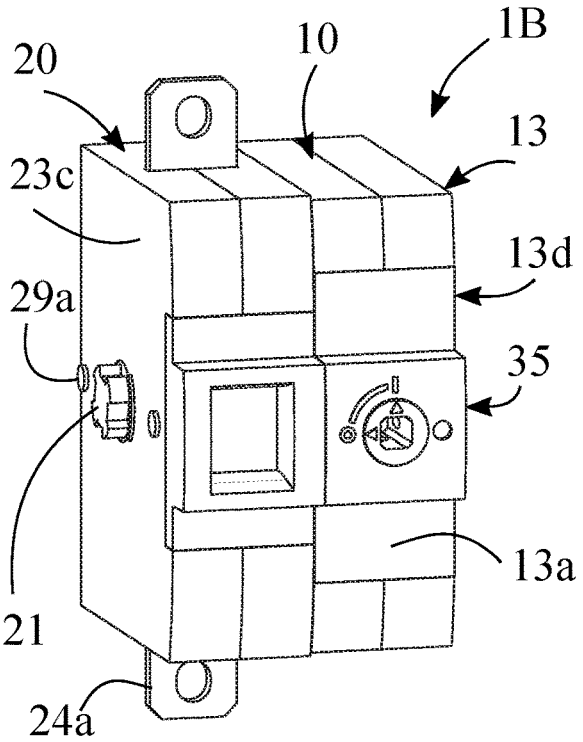
Figure 4A:
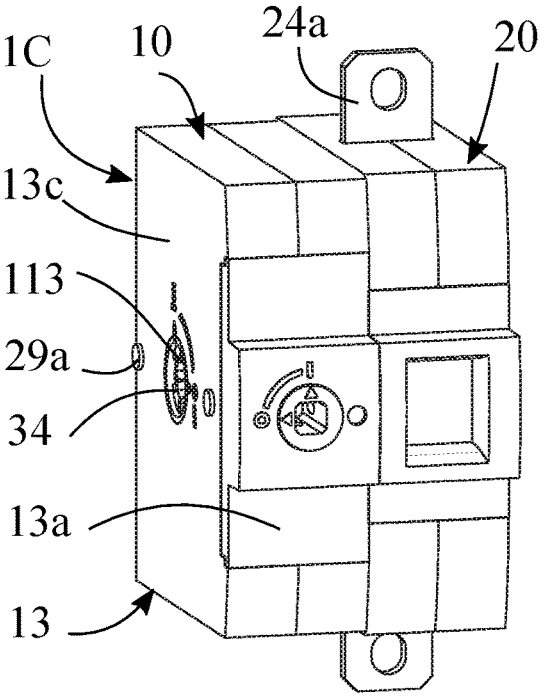
FIGS. 4A and 4B are views of a modular switching device according to the invention obtained by juxtaposing a switching module on the right of the control module, respectively in a front perspective view and in a left side view.
Figure 4B:
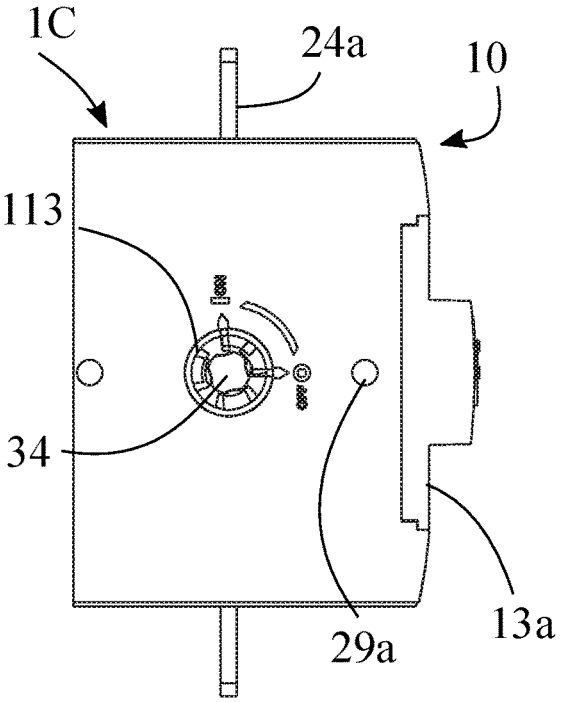

Control module 10 according to the invention is in addition designed to meet all possible control modes depending on the installation of switching device 1A, 1B, 1C, 1D, 1E: front control (FIGS. 1, 2, 3A, 3B, 4A, 4B, 10, 11 and 12), right side control (FIG. 3A, 3B, 12) and left side control (FIGS. 4A and 4B). Moreover, in all possible control modes, control module 10 according to the invention allows complying with an imposed direction of operation to pass from a switched-off position (0) to a switched-on position (1), that is to say a clockwise quarter-turn rotary movement for a front control and an upwards movement for a side control regardless of whether this side control is left or right. When this control is manual, it is performed by means of an operating element such as a handle 2 provided at the end of a control rod 3, a swiveling lever, a remote control on the door of an electrical cabinet, or any other equivalent means. This control can also be mechanized with a motorized actuator.

Figure 6:
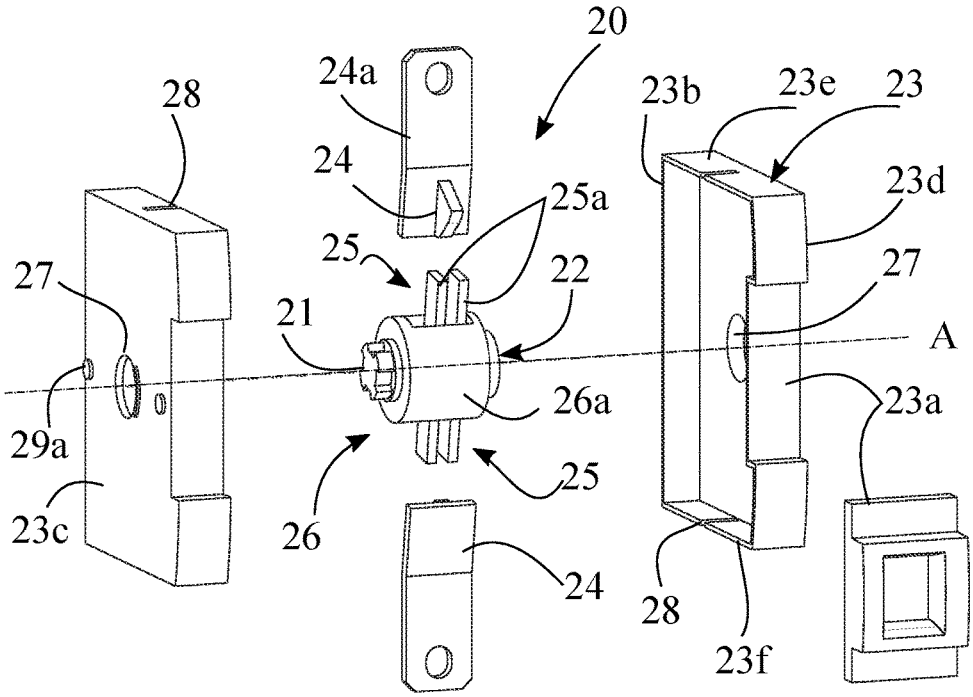
FIG. 6 is an exploded perspective view of a switching module of FIG. 1.
Figure 7A:
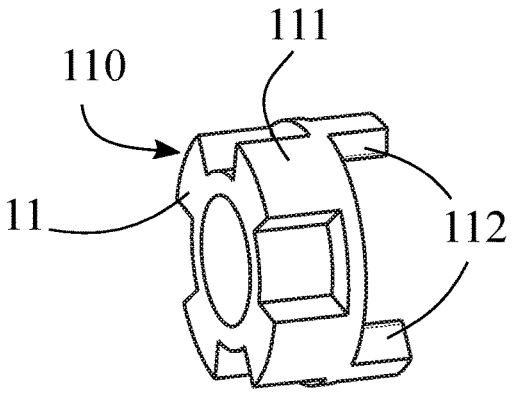
FIGS. 7A to 7D are detail views of the left coupling part of FIG. 1, respectively in a front perspective view, in a rear perspective view, in a front view and in a rear view.
Figure 7C:
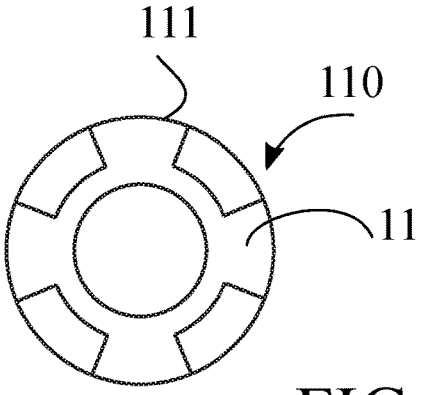
Figure 7D:
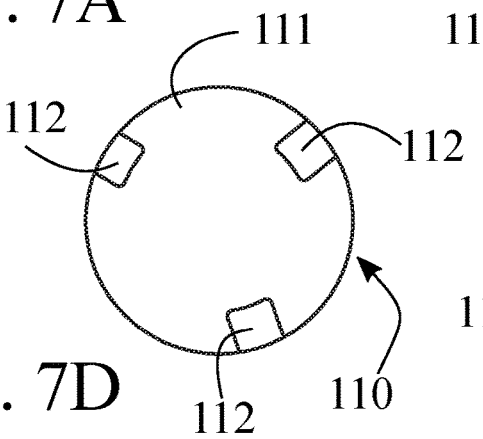
Figure 7B:
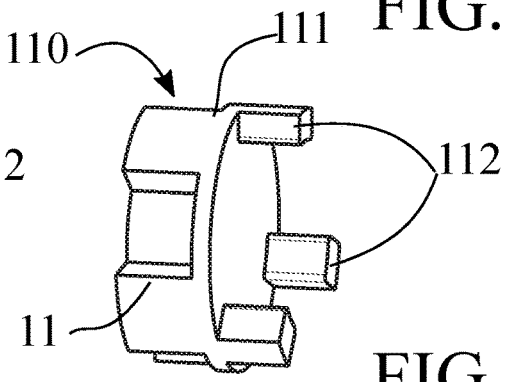
Figure 8C:
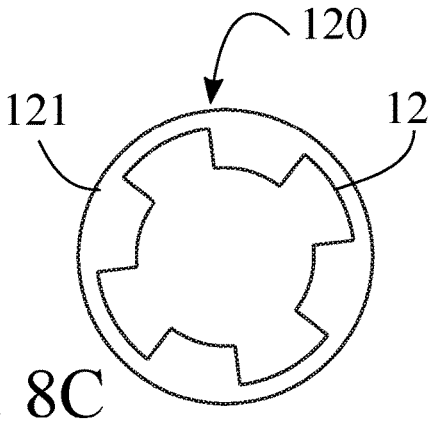
FIGS. 8A to 8D are detail views of the right coupling part of FIG. 1, respectively in a front perspective view, in a rear perspective view, in a front view and in a rear view.
Figure 8A:
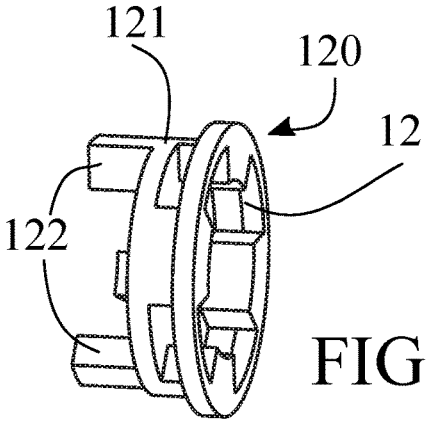
Figure 8B:
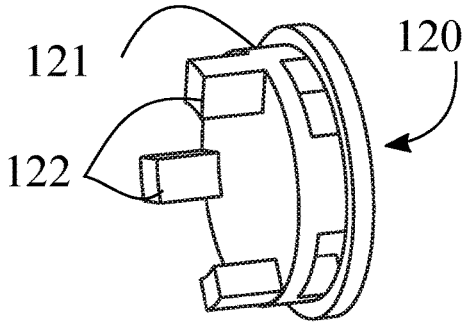
Figure 8D:
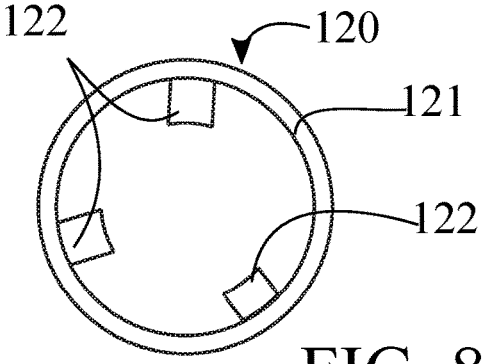

An example of a switching module 20 according to the invention is represented as an exploded view in FIG. 6 and comprises a switching casing 23 that contains a pair of fixed contacts 24 and a pair of moving contacts 25 coupled with a transmission mechanism 26 that rotates about a rotation axis A. Each fixed contact 24 made of an electrically conductive material is supported by a connection area 24*a* extending outside of casing 23 and allowing connecting it to an electrical conductor of the installation. Each moving contact 25 comprises two blades 25*a* made of an electrically conductive material, parallel and integral with a rotary rod 26*a* to form pivoting sliding contacts arranged to enclose corresponding fixed contact 24 on either side in switched-on or closed position. Rotary rod 26*a* comprises at its ends two coupling end pieces 21, 22 and forms transmission mechanism 26, which could be different according to the configuration of fixed contacts 24 and moving contacts 25. The moving contacts could be pressure contacts. In this case, transmission mechanism 26 would be designed to transform a rotary movement about rotation axis A into a translation movement of the moving contacts. The invention is therefore not limited to the illustrated embodiment. Coupling end pieces 21, 22 are designed to fit axially into other complementary coupling end pieces 21, 22; 11, 12 provided either on another switching module 20 or on control module 10. To this purpose, one of coupling end pieces 21 is a male end piece provided on the left side of switching casing 23 seen from the front (on the left in the figures) and the other coupling end piece 22 is a female end piece provided on the right side of switching casing 23 (on the right in the figures). Of course, the male 21 and female 22 coupling end pieces can be inverted, the male end piece can be provided on the right side and the female end piece on the left side of switching casing 23. They have each the shape of a cross in relief for male coupling end piece 21 and the shape of a recessed cross for female coupling end piece 22, allowing an axial fitting with other complementary coupling end pieces 21, 22; 11, 12 according to rotation axis A and a rotating actuation without play about said rotation axis A. Of course, any other coupling end piece shape operating the same functions can be considered, since every switching device manufacturer generally has its own coupling end pieces.

Figure 9C:
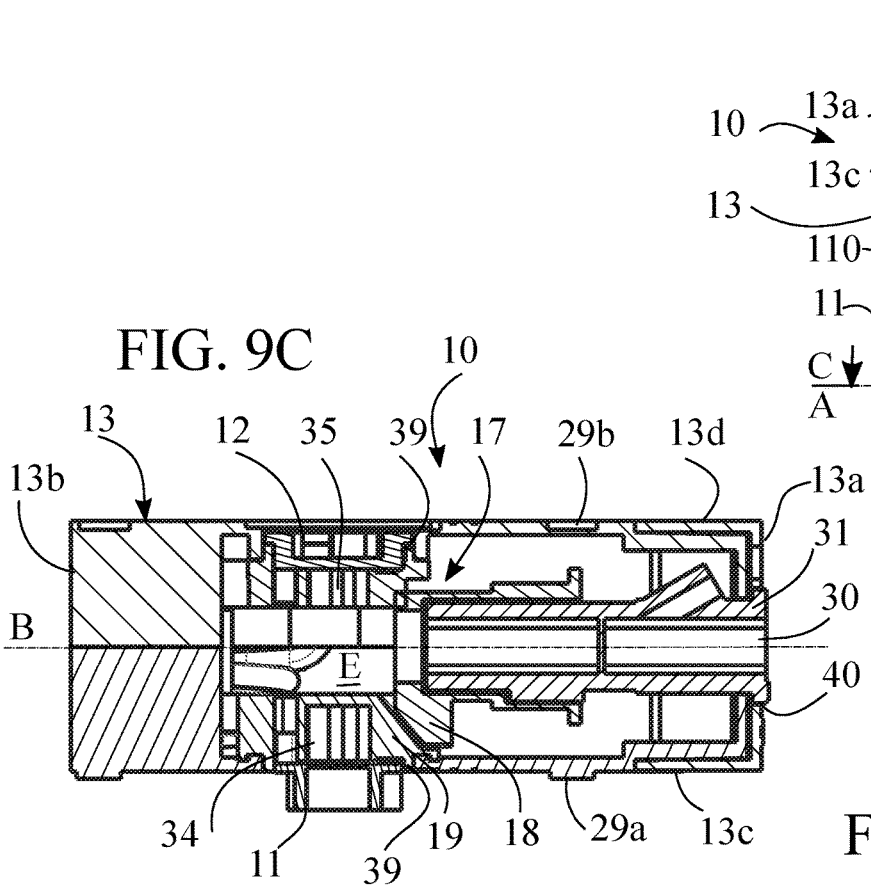
FIGS. 9, 9A, 9B and 9C are views of the control module of FIG. 5, respectively in a front view, an AA cross-section, a BB cross-section and a CC cross-section.
Figure 9:
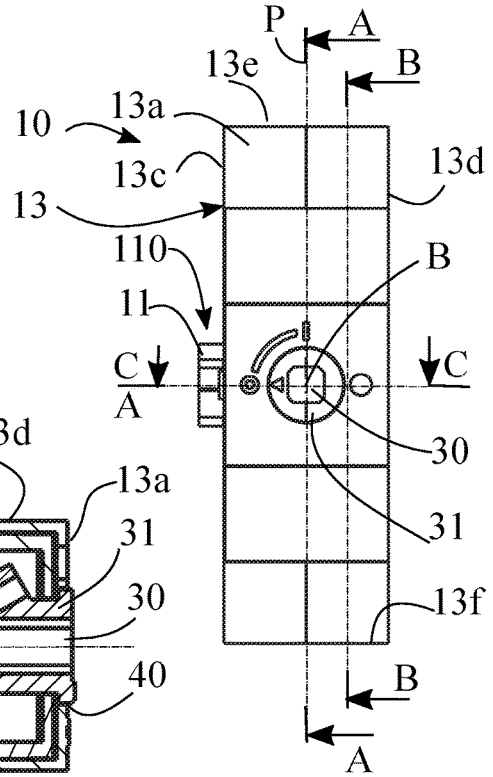

Switching casing 23 of switching module 20 has a parallelepipedic shape, is made of an electrically insulating material, and comprises two half shells assembled along a median parting line P (see FIG. 9 relating to control module 10). It defines a front wall 23*a* that forms the front of the casing, a rear wall 23*b*, two side walls 23*c*, 23*d* that form the sides of the casing and two transversal walls 23*e*, 23*f*. Side walls 23*c*, 23*d* of switching casing 23 comprise a guiding opening 27 for the passage of coupling end pieces 21, 22 and the rotational guiding of rotary rod 26*a* about rotation axis A. Transversal walls 23*e*, 23*f* of switching casing 23 comprise a slot 28 for the passage and the holding of connection areas 24*a* of fixed contacts 24. Side walls 23*c*, 23*d* of switching casing 23 comprise respectively two centering pins 29*a* and two corresponding centering holes 29*b* (see FIG. 9C relating to control module 10 and FIG. 12 relating to device 1B), diametrically opposed with respect to rotation axis A, to facilitate the centering of modules 10, 20 on each other when assembling them by juxtaposition side by side. The number of centering pins and holes 29*a*, 29*b* can be limited to one or exceed two. Likewise, other equivalent centering means can be considered.

Figure 5:
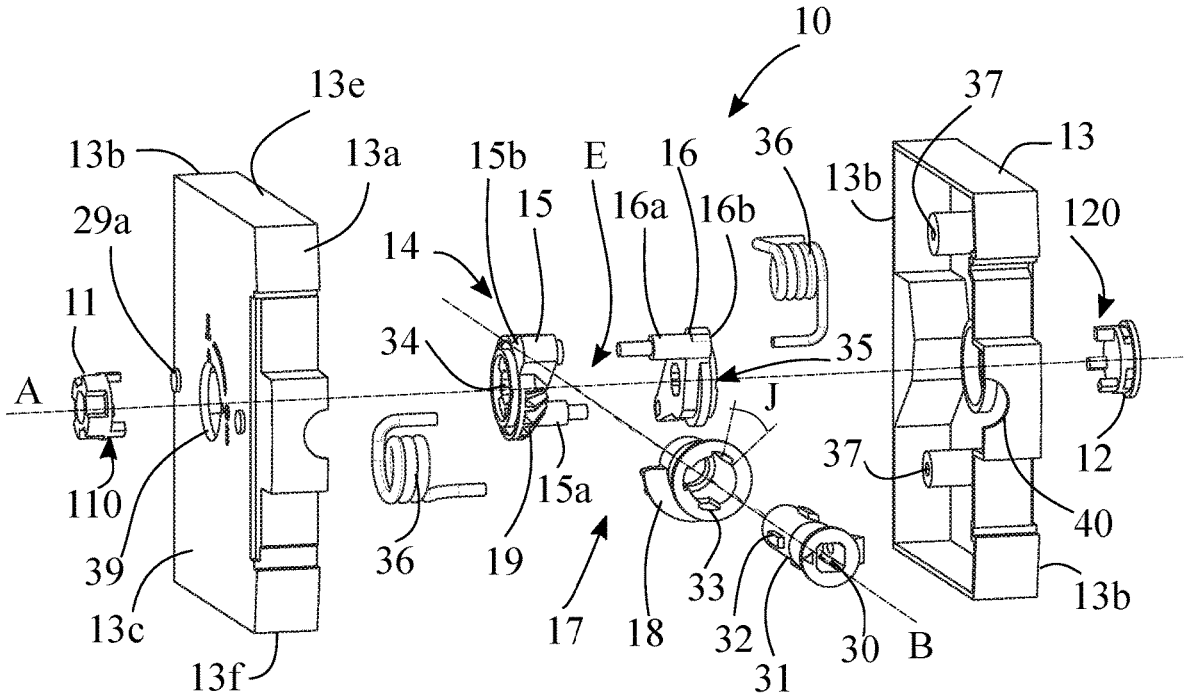
FIG. 5 is an exploded perspective view of the control module of FIG. 1.
Figure 9B:
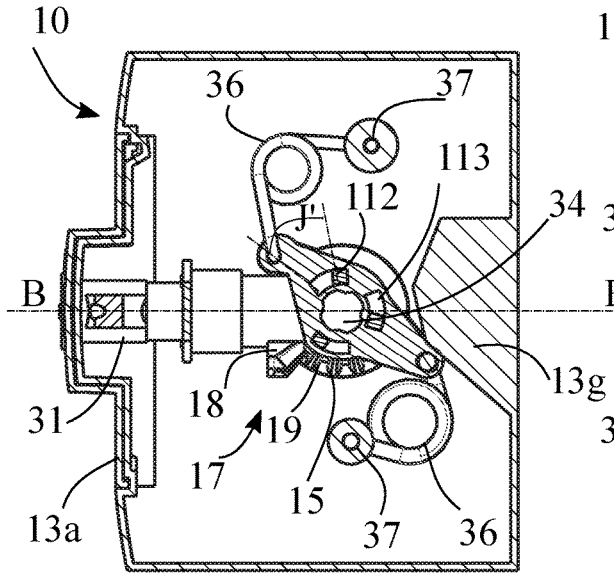
Figure 9A:
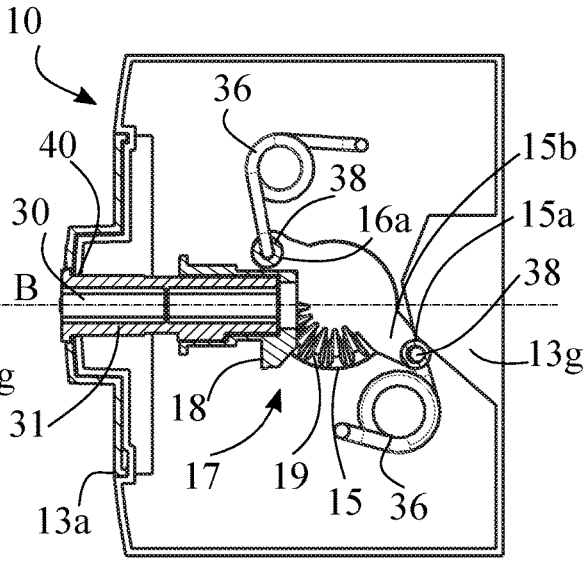

Control module 10 according to the invention is represented in an exploded view in FIG. 5 and comprises a control casing 13 containing an actuating mechanism 14 that rotates about a rotation axis that coincides with rotation axis A of transmission mechanism 26 when control module 10 and at least one switching module 20 are juxtaposed, this rotation axis bearing also reference A. The actuating mechanism 14 comprises a hollow shaft made of two substantially cylindrical, coaxial shaft parts 15, 16 assembled axially together by connecting arms 15*a*, 16*a* to provide a central recess E wherein an angle transmission 17 is housed at least partly. In the represented example, there are two parallel connecting arms 15*a*, 16*a* arranged on two ears 15*b*, 16*b* provided in diametrically opposed locations on shaft parts 15, 16. These connecting arms 15*a*, 16*a* also have a limit switch function, as they abut against fixed parts (boss 13*g* visible on FIGS. 9A and 9B) of control module 10 to delimit the extreme angular positions actuating mechanism 14 can reach and that correspond to the switched-on and switched-off positions of switching module 20. In the represented example the extreme angular positions of actuating mechanism 14 are separated by an angle substantially equal to 60°, without this value being limiting. To this purpose, control casing 13 comprises a boss 13*g* integral with rear wall 13*b* whose external shape defines two fixed stops which delimit the switched-on position and the switched-off position in collaboration with one and the other connecting arm 15*a*, 16*a*.

Angle transmission 17 comprises a bevel gear made of an input pinion 18 on axis B perpendicular to rotation axis A meshing an output pinion 19 on axis A provided on one of shaft parts 15. Input pinion 18 and output pinion 19 are defined by two angular sectors that cover slightly more than a quarter turn, which is sufficient for the actuation of transmission mechanism 26 of switching module 20 by rotating handle 2 on a quarter turn, that is to say 90°. These pinions could however be complete. Of course, any other equivalent embodiment of angle transmission 17 is possible. Input pinion 18 comprises a front entry opening 30 accessible through the front of control casing 13 to receive a control rod 3. Generally, control rod 3 has at least at one of its ends a square cross-section whose shape is reproduced as a recess in front entry opening 30 to ensure an axial fitting along axis B and the rotating actuation without play of angle transmission 17 by control rod 3, itself actuated by a handle 2 or the like. In this example, front entry opening 30 is arranged in an additional entry part 31 housed in input pinion 18, this additional entry part 31 is not necessarily mandatory. However, it allows introducing an angular play J (FIG. 5) explained below. In the represented example, additional entry part 31 comprises driving means 32 complementary to driving means 33 provided in input pinion 18 of angle transmission 17. They are made of three driving teeth 32, without this number being limiting, being specified that one driving tooth could be sufficient, but that three driving teeth 32 allow balancing the actuation efforts. Correspondingly, the complementary driving means provided in input pinion 18 comprise three receiving notches 33. Receiving notches 33 extend over an angular sector larger than that of driving teeth 32 to arrange an angular play J (FIG. 5) between the control rod and actuating mechanism 14 in order to dissociate transmission mechanism 26 of switching module 20 from the control rod over a predefined angular stroke. In fact, in the case where transmission mechanism 26 is associated with an abrupt actuation device 36 described below, this angular play J allows uncoupling abrupt actuation device 36 from the control rod, allowing it to release the potential energy it accumulated during a part of the rotation of the control rod to actuate transmission mechanism 26 of switching module 20 and quickly switch moving contacts 25 from their switched-off position to their switched-on position and vice-versa.

Actuating mechanism 14 of control module 10 comprises at its ends two other lateral entry openings 34, 35 accessible through the sides of control casing 13 and comprising the same recess as front entry opening 30 to receive an end of control rod 3. These lateral entry openings 34, 35 are arranged in shaft parts 15, 16 and centered on rotation axis A. Actuating mechanism 14 also comprises two coupling end pieces 11, 12 accessible through the sides of control casing 13, identical with coupling end pieces 21, 22 of switching module 20, aligned on rotation axis A to allow their respective axial fitting when control module 10 is juxtaposed to one or two switching modules 20.

Actuating mechanism 14 moreover comprises two springs 36, which are, in the represented example, torsion springs whose free ends are respectively housed in a receiving opening 37, 38 provided in control casing 13 and in shaft parts 15, 16. Any other spring type may be suitable such as, for example, compression springs. These springs 36 allow storing potential energy during the rotation of control rod 3, and subsequently to cause a quick switching of moving contacts 25 due to the restitution of the stored energy. These springs 36 form an abrupt actuation device that ensures the quick switch-on and switch-off of switching modules 20, independently of the actuation speed of control rod 3. Of course, this embodiment example of the abrupt actuation device is not limiting and extends to any other equivalent device form. Likewise, two springs 36 are represented but, depending on the load module to develop, one single spring 36 may be sufficient, the two springs 36 allowing to multiply by two the potential energy and to balance the actuation efforts.

Switching casing 13 of control module 10 has a parallelepipedic shape substantially identical to that of switching casing 23, is made of an electrically insulating material, and comprises two half shells assembled along a median parting line P (FIG. 9). It defines a front wall 13*a* that forms the front of the casing, a rear wall 13*b*, two side walls 13*c*, 13*d* that form the sides of the casing and two transversal walls 13*e*, 13*f*. Side walls 13*c*, 13*d* of control casing 13 comprise a guiding opening 39 for the passage of coupling end pieces 11, 12 and the rotational guiding of shaft parts 15, 16 of actuating mechanism 14 about rotation axis A. Front side 13*a* of control casing 13 comprises a guiding opening 40 for the passage and the guiding of additional entry part 31 comprising front entry opening 30 of actuating mechanism 14. As for switching casing 23, side walls 13*c*, 13*d* of control casing 13 comprise respectively two centering pins 29*a* and two corresponding centering holes 29*b* (FIG. 9C), diametrically opposed with respect to rotation axis A, to facilitate the centering of modules 10, 20 on each other when assembling them by juxtaposition side by side.

In the represented example, coupling end pieces 11, 12 of control module 10 are formed on distinct coupling parts 110, 120, separated from the shaft of actuating mechanism 14. They form two differentiated parts, that is to say one male coupling part 110 (FIG. 7A to 7D) and one female coupling part 120 (FIG. 8A to 8D). Of course, these coupling end pieces 11, 12 could be integrated in shaft parts 15, 16, and superimposed on side entry openings 34, 35. The advantage of providing coupling end pieces 11, 12 on distinct coupling parts 110, 120 allows adding an angular play J' that allows dissociating control rod 3 from actuating mechanism 14, as explained previously in reference to angular play J present at front entry opening 30. Consequently, the illustrated and described embodiment of coupling end pieces 11, 12 must not be limiting.

Male coupling part 110 illustrated in detail in FIGS. 7A to 7D comprises a cylindrical body 111 provided on the left side with male coupling end piece 11 and on the right side with driving means 112 arranged to fit in complementary driving means 113 provided in the corresponding end of the shaft of actuating mechanism 14. In the represented example, the driving means are made of three driving teeth 112, without this number being limiting, being specified that one driving tooth could be sufficient, but that three driving teeth allow balancing the actuation efforts. Correspondingly, the complementary driving means provided in the end of shaft part 15 comprise three receiving slots 113. Receiving slots 113 extend over an angular sector larger than that of driving teeth 112 to arrange an angular play J' (FIG. 9B) between control rod 3 and actuating mechanism 14, which has the same function as angular play J present at front entry opening 30. Driving teeth 112 and receiving slots 113 are irregularly distributed on the circumference of male coupling part 110 and of corresponding shaft part 15 to form coded means, to make sure that male coupling part 110 can only fit on the left side of control module 10. Of course, if coupling end pieces 11, 12; 21, 22 of the various modules 10, 20 are inverted, male coupling part 110 will have to fit in the right side of control module 10.

Female coupling part 120 illustrated in detail in FIGS. 8A to 8D comprises a cylindrical body 121 provided on the right side with female coupling end piece 12 and on the left side with driving means 122 arranged to fit in complementary driving means 123 provided in the corresponding end of the shaft of actuating mechanism 14. In the represented example and as for male coupling part 110, the driving means are made of three driving teeth 122, and the complementary driving means provided in the end of shaft part 16 comprise three receiving slots 123. Receiving slots 123 extend over an angular sector larger than that of driving teeth 122 to arrange also an angular play J' between control rod 3 and actuating mechanism 14, which has the same function as angular play J present at front entry opening 30 and at side entry opening 34. Driving teeth 122 and receiving slots 123 are irregularly distributed on the circumference of female coupling part 120 and of corresponding shaft part 16 to form coded means, to make sure that female coupling part 120 can only fit on the right side of control module 10. As specified above, if coupling end pieces 11, 12; 21, 22 of the various modules 10, 20 are inverted, female coupling part 120 will have to fit in the left side of control module 10.

Figure 11:
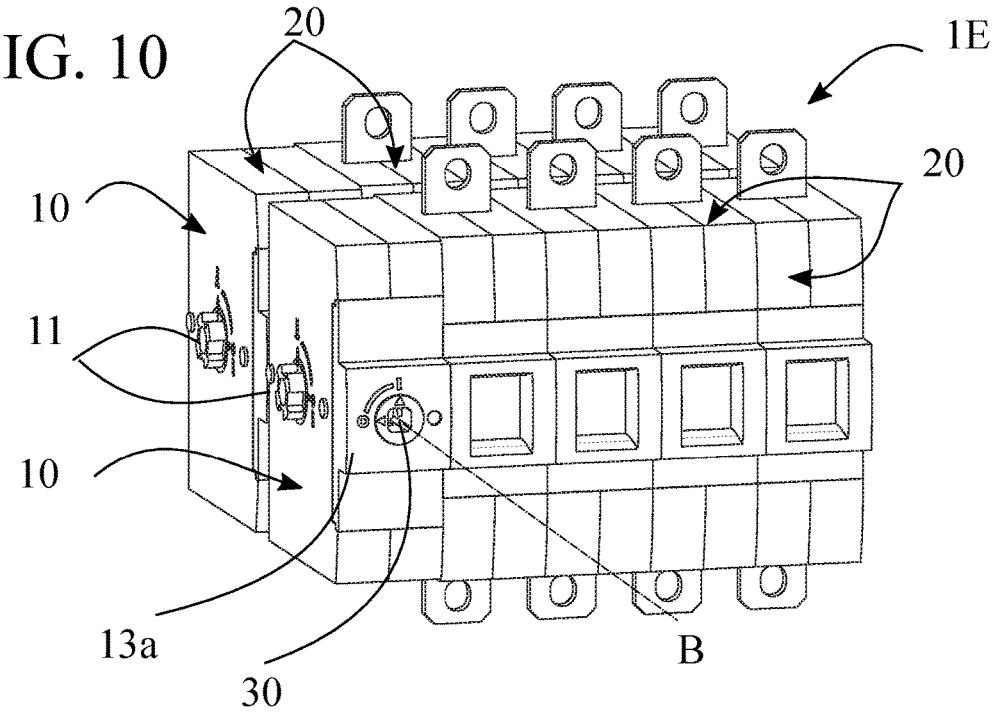
FIG. 11 is a perspective view of a switch obtained by juxtaposing one behind the other two switching devices according to the invention, comprising two adjacent side control modules.

Possibilities for Industrial Application:

The control module 10 according to the invention is versatile, as it allows realizing all switching device configurations, as it can be juxtaposed to one or several switching modules 20 on one and/or on the other of its sides. If it is juxtaposed to a switching module 20 on one of its sides, control rod 3 can be introduced as well in front entry opening 30 to realize a front control as in side entry opening 34, 35 on the free side of control module 10 to realize a side control. FIGS. 3A, 3B, 4A, 4B, 11 and 12 illustrate different switching devices 1B, 1C, 1E obtained with this lateral assembly mode comprising either one switching module 20 for devices 1B, 1C of FIGS. 3A, 3B, 4A, 4B and 12 forming single-phase switches, or more than one switching module and for example eight switching modules 20 for device 1E of FIG. 11 forming a multiphase two-stage switch. FIG. 11 illustrates a switch obtained by superposition, one behind the other, of two same switching devices provided with four switching modules 20, corresponding to two four-phase switches, joined together at their control module 10 by means of a connecting rod (not represented).

Figure 2:
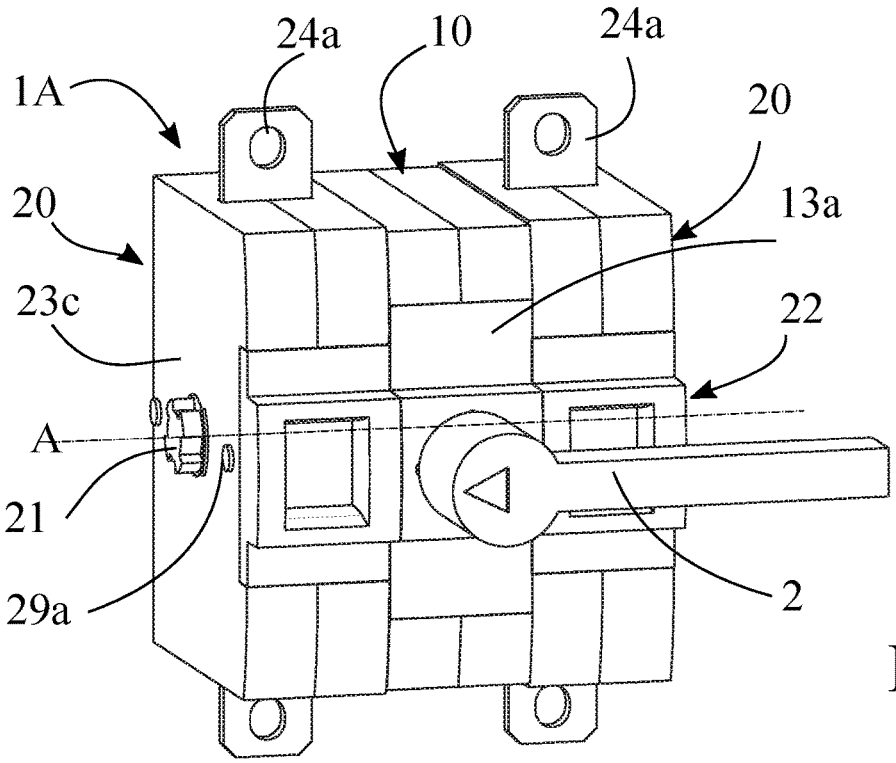
FIG. 2 is a general perspective view of the switching device of FIG. 1, FIGS. 3A and 3B are views of a modular switching device according to the invention obtained by juxtaposing a switching module on the left of the control module, respectively in a front perspective view and in a right side view.
Figure 10:
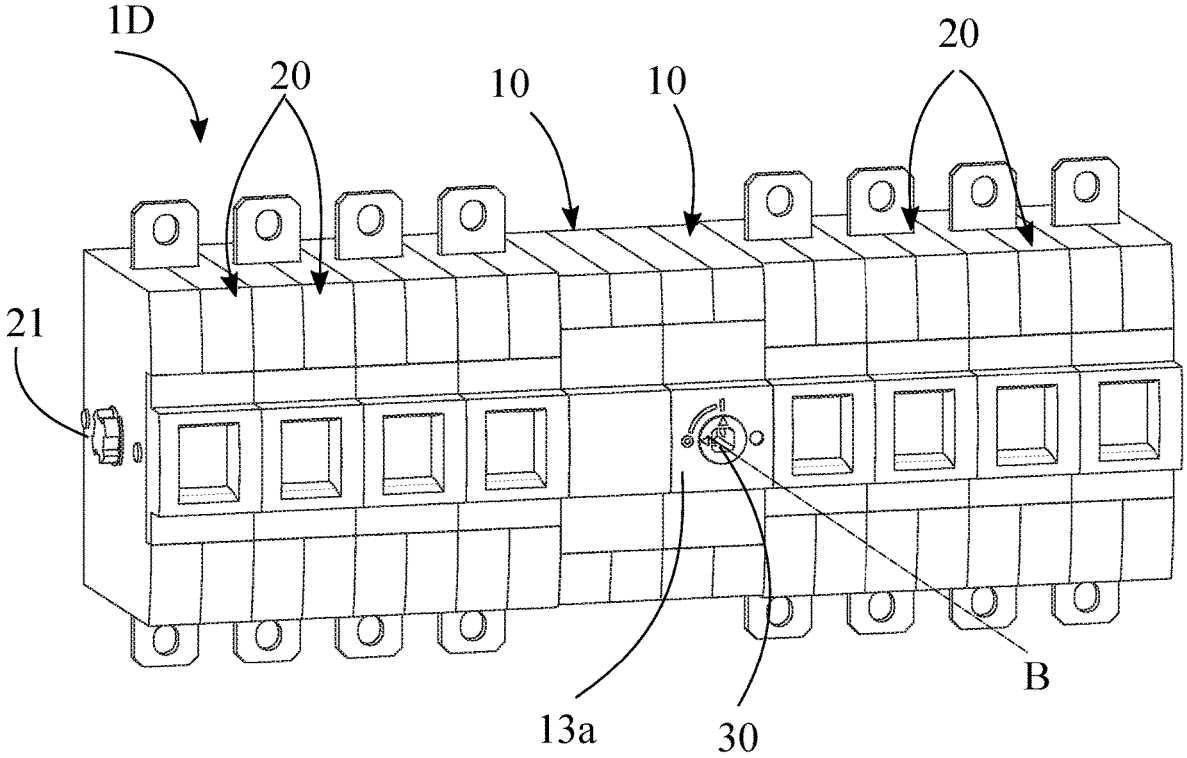
FIG. 10 is a perspective view of a switch obtained by juxtaposing side by side two switching devices according to the invention, comprising two central and adjacent control modules.

If control module 10 is juxtaposed to a switching module 20 on both of its sides, control rod 3 can only be introduced in front entry opening 30 to realize a font control. FIGS. 1, 2 and 10 illustrate different switching devices 1A, 1D obtained with this lateral assembly mode comprising either two switching modules for device 1A of FIG. 1, 2 forming a two-phase switch, or more than two switching modules and for example eight switching modules 20 for device 1D of FIG. 11 forming a multiphase switch by assembling two four-phase switches side by side. In this case, front entry opening 30 of one of control modules 10 is closed.

Figure 12:
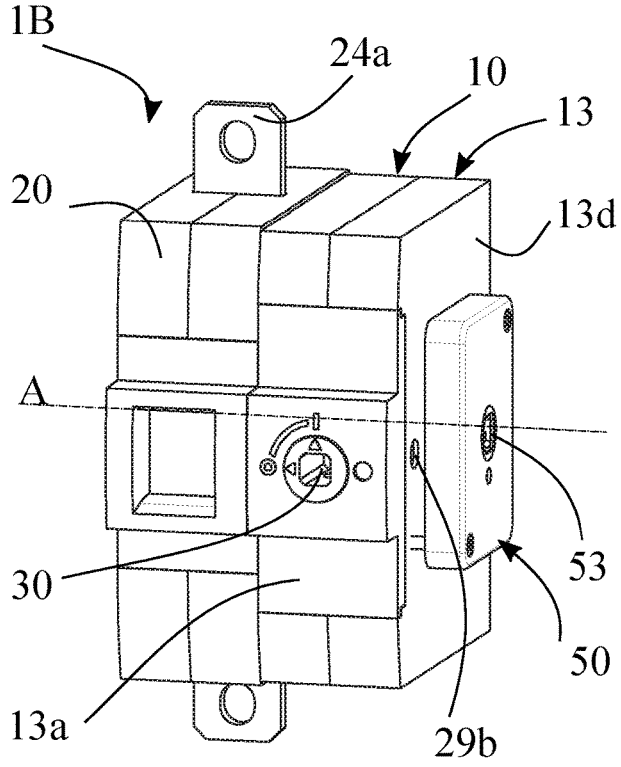
FIG. 12 is a perspective view of the switching device of FIG. 3A, completed with a side control accessory.
Figure 13:
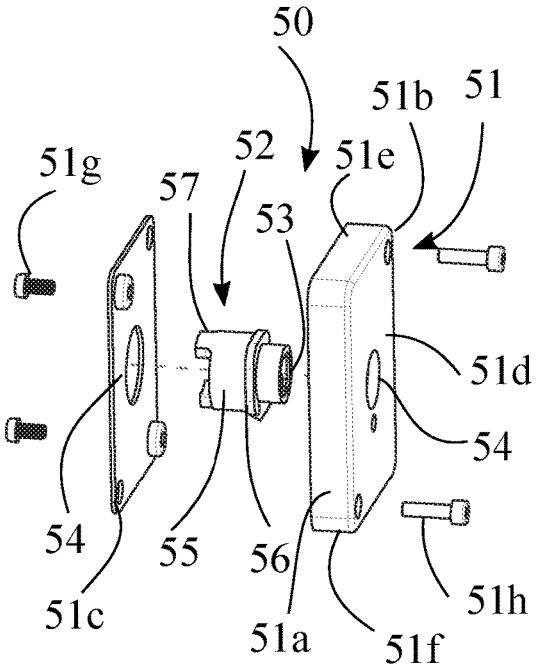
FIG. 13 is an exploded perspective view of the side control accessory.

Switching device 1B of FIG. 12 corresponds to that of FIGS. 3A and 3B, completed with a side control accessory 50 allowing for example to consider a direct side control and/or a control of auxiliary contacts (not represented) to provide information about the switching position of switching device 1B by means of an electrical signal. This side control accessory 50 is illustrated more in detail in FIG. 13 and comprises an accessory casing 51 containing an additional coupling part 52 provided with an additional side entry opening 53 to receive the corresponding end of a control rod 3. This additional side entry opening 53 consequently comprises a recess identical with that provided in front entry opening 30 and in side entry openings 34, 35 of control module 10.

Accessory casing 51 is narrower than control casing 13 and switching casing 23, as it contains only few parts. It has a parallelepipedic shape, is made of an electrically insulating material, formed as an open shell closed by a closing plate by means of fastening screws 51*g*. It is intended to be attached on a side face 13*c*, 13*d* of control casing 13 by means of fastening screws 51*h*. It defines a front wall 51*a*, a rear wall 51*b*, two side walls 51*c*, 51*d* that form the sides of the casing and two transversal walls 51*e*, 51*f*. Side walls 51*c*, 51*d* of accessory casing 51 comprise a guiding opening 54 for the passage and the rotational guiding of additional coupling part 52 about rotation axis A. Additional coupling part 52 comprises a cylindrical body 55 provided with a shoulder 56 that rests on the internal side of right side wall 51*d* of accessory housing 51, and that delimits on the right side additional side entry opening 53 and on the left side driving means 57 arranged to fit in complementary driving means 123 provided in the corresponding end of the shaft of actuating mechanism 14. In the represented example and as for coupling parts 110, 120, the driving means are made of three driving teeth 57 corresponding to the three receiving slots 123 provided in shaft part 16. Driving teeth 57 extend over an angular sector smaller than that of receiving slots 123 to preserve angular play J' between control rod 3 and actuating mechanism 14. Driving teeth 57 and receiving slots 123 form together coded means making sure that side control accessory 50 can only fit on the right side of control module 10. Of course, another side control accessory 50 can be realized specifically to fit on the left side of control module 10.

Figure 14:
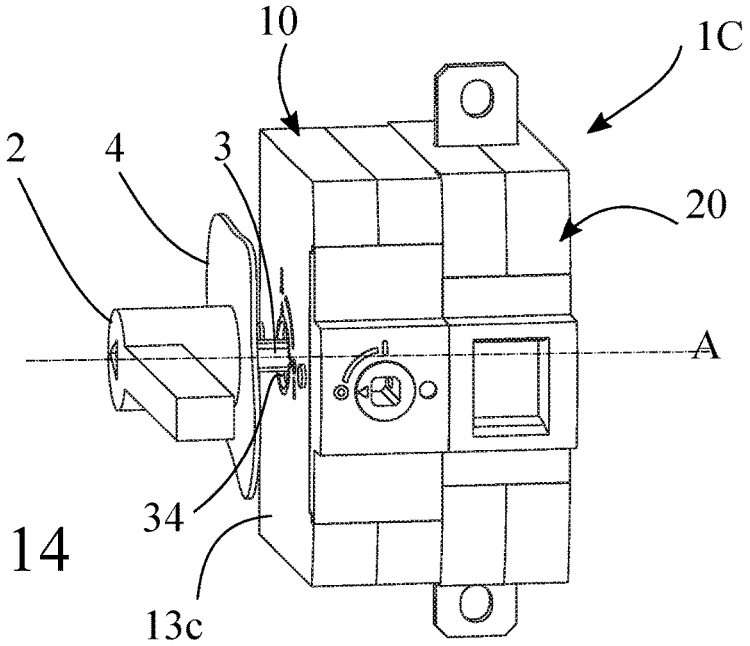
FIG. 14 is a perspective view of the switching device of FIG. 4A with a side control, without side control accessory.

Switching device 1C of FIG. 14 corresponds to that of FIGS. 4A and 4B, which has no side control accessory 50 and allows a remote side control on the door of an electrical cabinet. In this configuration, handle 2 is arranged on the outside of a wall 4 belonging to the electrical cabinet (not represented) and is coupled to control module 10 by a control rod 3 that passes through wall 4 provided with a corresponding opening 5. This handle 2 is locked axially by any locking means provided on either side of wall 4 but is not represented.

This description shows clearly that the invention allows reaching the goals defined, that is to say offer a control module 10 for a modular switching device, that is versatile, with a simple and reliable design, that allows meeting all required functionalities, in particular:

An imposed direction of operation of switching modules 20, that is to say an upwards rotation to close switching modules 20 when the operator is facing switching device 1A, 1B, 1C, 1D 1E, A rotary front control, A rotary right side control, A rotary left side control, A control module 10 centered when switching modules 20 are coupled on each side, A direct control or a remote control on a cabinet door, A coupling of two switches side by side (FIG. 10) or one behind the other (FIG. 11) to realize a multiphase switch, A coupling of several control modules 10 to multiply the number of switching modules 20 actuated (FIG. 10), Auxiliary contacts that can be integrated using side control accessory 50.

The present invention is not restricted to the examples of embodiment described, but extends to any modification and variant which is obvious to a person skilled in the art.

The invention claimed is:

1. A control module (10) for a modular electrical switching device (1A, 1B, 1C, 1D, 1E) obtained by juxtaposing the control module (10) and at least one switching module (20), the switching module (20) comprising a switching casing (23) containing at least one fixed contact (24) and one moving contact (25) coupled to a transmission mechanism (26) that rotates about a rotation axis (A) and is provided with two coupling end pieces (21, 22) accessible on sides of the switching casing (23), the control module (10) comprising a control casing (13) containing an actuating mechanism (14) that rotates about a rotation axis arranged to coincide with the rotation axis (A) of the transmission mechanism (26), when the switching module (10) and the at least one control module (20) are juxtaposed, the actuating mechanism (14) being provided with two coupling end pieces (11, 12) accessible on the sides of the control casing (13), arranged to be complementary to the coupling end pieces (21, 22) of the at least one switching module (20) and aligned therewith on the same rotation axis (A) to allow axial fitting, when the control module (10) and the at least one switching module (20) are juxtaposed, the control module (10) comprising a control rod (3) coupled, on the one hand, to the actuating mechanism (14) through a front side of the control casing (13) and, on another hand, to an operating element (2) located outside of the control casing (13), the actuating mechanism (14) being provided with a front entry opening (30) accessible through the front side of the control casing (13) and comprising a recess to receive an end of the control rod (3) and realize a front control of the control module (10), wherein the actuating mechanism (14) comprises two side entry openings (34, 35) accessible on the sides of the control casing (13), aligned with the rotation axis (A) of the actuating mechanism (14), and comprising the same recess as front entry opening (30) to receive an end of the control rod (3) and realize a right side control or a left side control of the control module (10), respecting a same direction of operation on a right and on a left of the control module (10).

2. The control module according to claim 1, wherein the coupling end pieces (11, 12) of the actuating mechanism (14) are integrated in the actuating mechanism (14).

3. The control module according to claim 1, wherein the control module comprises at least one spring (36) coupled to the control casing (13) and to the actuating mechanism (14), arranged to form an abrupt actuation device for the moving contacts of the at least one switching module (20), when the modules (10, 20) are juxtaposed.

4. The control module according to claim 1, wherein the coupling end pieces (11, 12) of the actuating mechanism (14) of the control module (10) are integrated in the actuating mechanism (14).

5. The control module according to claim 1, wherein the actuating mechanism (14) comprises a hollow shaft made of two coaxial shaft parts (15, 16) assembled axially together by connecting arms (15*a*, 16*a*) to provide a central recess (E).

6. The control module according to claim 5, wherein the connecting arms (15*a*, 16*a*) form end positions with fixed parts of the control module (10) to delimit the extreme angular positions that the actuating mechanism (14) reaches and which correspond to the switched-on and switched-off positions of the at least one switching module (20), when the modules (10, 20) are juxtaposed.

7. The control module according to claim 1, wherein the actuating mechanism (14) comprises an angle transmission (17) made of at least one input gear (18) and one output gear (19) integral with the actuating mechanism (14), and an additional entry part (31) comprising the front entry opening (30), housed in the input gear (18) by complementary driving means (32, 33) that allow their rotational coupling about an axis (B) perpendicular to the rotation axis (A) of the actuating mechanism (14).

8. The control module according to claim 7, wherein the complementary driving means (32, 33) of the additional entry part (31) are arranged to leave angular play (J) between the control rod (3) and the actuating mechanism (14) in case of a front control.

9. The control module according to claim 8, wherein the complementary driving means of the additional entry part (31) comprise at least one driving tooth (32) provided on the additional entry part (31) or on the input pinion (18), and at least one receiving notch (33) provided on the input pinion (18) or on the additional entry part (31), and the receiving notch (33) extends over an angular sector that is larger than that of the driving tooth (32) to leave the angular play (J).

10. A modular switching device (1A, 1B, 1C, 1D, 1E) obtained by juxtaposing a control module (10) according to claim 1 and at least one switching module (20), the switching module (20) comprising a switching casing (23) containing at least one fixed contact (24) and one moving contact (25) coupled to a transmission mechanism (26) that rotates about a rotation axis (A) and is provided with two coupling end pieces (21, 22) accessible on the sides of the switching casing (23), the control module (10) comprising a control casing (13) containing an actuating mechanism (14) that rotates about the rotation axis (A) and is provided with two coupling end pieces (11, 12) accessible on the sides of the control casing (13), complementary to the coupling end pieces (21, 22) of the at least one switching module (20) and aligned on the same rotation axis (A), the control module (10) comprising a control rod (3) coupled, on the one hand, to the actuating mechanism (14) through a front side of the control casing (13) and, on another hand, to an operating element (2) located outside of the control casing (13), the actuating mechanism (14) being provided with a front entry opening (30) accessible through the front side of the control casing (13) and comprising a recess to receive an end of the control rod (3) and realize a front control of the control module (10), wherein the actuating mechanism (14) of the control module (10) comprises two side entry openings (34, 35) accessible on the sides of the control casing (13), aligned on the rotation axis (A) of the actuating mechanism (14), and comprising the same recess as front entry opening (30) to receive an end of the control rod (3) and realize a right side control or a left side control of the control module (10), respecting a same direction of operation on the right and on the left of the control module (10).

11. The switching device according to claim 10, wherein the switching device comprises at least one switching module (20) juxtaposed to one of the sides of the control module (10), and the control rod (3) is coupled to the front entry opening (30) of the control module (10) to realize a front control of the switching device, or to the side entry opening (34, 35) of a free side of the control module (10) to realize a side control of the switching device.

12. The switching device according to claim 10, wherein the switching device comprises at least one switching module (20) juxtaposed to each side of the control module (10) and the control rod (3) is coupled to the front entry opening (30) of the control module (10) to realize a front control of the switching device.

13. The switching device according to claim 10, wherein the switching device comprises a side control accessory (50) with an accessory casing (51) provided with an additional coupling part (52) comprising, at one of its ends, an additional side entry opening (53) to receive the end of a control rod (3) and, at another end, fitting means (57) complementary to those of the actuating mechanism (14) of the control module (10).

14. The switching device according to claim 10, wherein the coupling end pieces (11, 12) of the actuating mechanism (14) of the control module (10) are formed on distinct coupling parts (110, 120), separated from the actuating mechanism (14), arranged to be inserted between the actuating mechanism (14) of the control module (10) and the transmission mechanism (26) of the at least one switching module (20).

15. The switching device according to claim 14, wherein the coupling parts (110, 120) form a male coupling part (110) and a female coupling part (120), the male coupling part (110) comprises a male coupling end piece (11) and the female coupling part (120) comprises a female coupling end piece (12), the male (11) and female (12) coupling end pieces are complementary respectively to the female (22) and male (21) coupling end pieces of the at least one switching module (20).

16. The control module according to claim 1, wherein the coupling end pieces (11, 12) of the actuating mechanism (14) are formed on distinct coupling parts (110, 120), separated from the actuating mechanism (14), arranged to be inserted between the actuating mechanism (14) of the control module (10) and the transmission mechanism (26) of the at least one switching module (20), when the modules (10, 20) are juxtaposed.

17. The control module according to claim 16, wherein the coupling parts form a male coupling part (110) and a female coupling part (120), one of the coupling parts comprises a male coupling end piece (11) and the other coupling part comprises a female coupling end piece (12), the male (11) and female (12) coupling end pieces are arranged to be complementary respectively to the female (22) and male (21) coupling end pieces of the at least one switching module (20), when the modules (10, 20) are juxtaposed.

18. The control module according to claim 16, wherein the coupling parts (110, 120) and the control casing (13) comprise coded means making sure that every coupling part corresponds to one of the sides of the control casing (13).

19. The control module according to claim 16, wherein the actuating mechanism (14) and the coupling parts (110, 120) comprise complementary driving means (112, 113; 122, 123) that allow coupling them in rotation about the rotation axis (A).

20. The control module according to claim 19, wherein the complementary driving means (112, 113; 122, 123) are arranged to leave angular play (J') between the control rod (3) and the actuating mechanism (14).

21. The control module according to claim 20, wherein the complementary driving means comprise at least one driving tooth (112, 122) provided on the coupling part (110, 120) or at the corresponding end of the actuating mechanism (14), and at least one receiving slot (113, 123) provided at the corresponding end of the actuating mechanism (14) or on the coupling part (110, 120), the receiving slot (113, 123) extends over an angular sector that is larger than that of the driving tooth to leave the angular play (J').

* * * * *